US006932219B2

(12) United States Patent
Chacko et al.

(10) Patent No.: US 6,932,219 B2
(45) Date of Patent: Aug. 23, 2005

(54) MULTI-PACK PACKAGING SLEEVE

(75) Inventors: Bobby J. Chacko, New York, NY (US); Pamela D. Moore, Chesterfield, VA (US); Mark K. Walchak, Summit, NJ (US); Barbara A. Kovach, Union, NJ (US); Boris Blitshtein, Manalapan, NJ (US); Marty Zarett, New York, NY (US); Antonio Giusto, Flanders, NJ (US); Genine E. Regante, New York, NY (US)

(73) Assignee: Philip Morris USA Inc., Richmond, VA (US)

( * ) Notice: Subject to any disclaimer, the term of this patent is extended or adjusted under 35 U.S.C. 154(b) by 9 days.

(21) Appl. No.: 10/243,278

(22) Filed: Sep. 13, 2002

(65) Prior Publication Data

US 2003/0121805 A1 Jul. 3, 2003

Related U.S. Application Data

(60) Provisional application No. 60/323,064, filed on Sep. 18, 2001.

(51) Int. Cl.[7] ..... B65D 85/10

(52) U.S. Cl. ..... 206/526; 206/256; 229/120.09; 211/72; 211/73

(58) Field of Search ..... 206/526, 242, 206/256, 268, 271, 273; 211/72, 73; 229/120.09, 120.01, 120.011, 120.012

(56) References Cited

U.S. PATENT DOCUMENTS

| | | | | | |
|---|---|---|---|---|---|
| 2,678,724 | A | * | 5/1954 | Andriot, Jr. | 206/393 |
| 3,039,671 | A | | 6/1962 | Chiamardas | |
| 3,101,880 | A | * | 8/1963 | Peterson | 229/120.012 |
| 3,158,312 | A | * | 11/1964 | Simkins | 229/120.011 |
| 3,172,530 | A | | 3/1965 | Grabosky et al. | |
| 3,241,738 | A | * | 3/1966 | Freiman | 229/120.011 |
| 3,341,103 | A | * | 9/1967 | May | 229/120.09 |
| 3,677,458 | A | * | 7/1972 | Gosling | 229/120.011 |
| 3,785,545 | A | | 1/1974 | Roussel | |
| 4,205,776 | A | * | 6/1980 | RuWalther | 229/120.011 |
| 4,485,926 | A | * | 12/1984 | Lenzmeier | 229/120.011 |
| 5,048,690 | A | * | 9/1991 | Zimmerman | 206/746 |
| 5,181,607 | A | * | 1/1993 | Focke et al. | 206/273 |
| 5,344,008 | A | | 9/1994 | DeBlasio et al. | |
| 5,722,583 | A | * | 3/1998 | Focke et al. | 229/120.011 |

* cited by examiner

*Primary Examiner*—Jim Foster
(74) *Attorney, Agent, or Firm*—Connolly Bove Lodge & Hutz LLP

(57) ABSTRACT

A multi-pack packaging sleeve comprising first and second pack receiving pockets each having at least one open end for insertion of product packs. A vertical hinge line is positioned between the pockets, and a vertical slotted opening between the pockets extends from one end of the hinge line. Each pack receiving pocket is constructed and arranged to receive a single product pack, or multiple packs may be received within at least one of the pockets. Closure flaps may be provided to close one end of each pocket.

14 Claims, 5 Drawing Sheets

MULTI-PACK PACKAGING SLEEVE

This application claims the benefit of Provisional application Ser. No. 60/323,064, filed Sep. 18, 2001.

BACKGROUND OF THE INVENTION

The present invention relates to a multi-pack packaging sleeve having a vertical hinge between adjacent pack receiving pockets, and more particularly to a sleeve having a first pocket for receiving one product pack and an adjacent second pocket on the other side of the vertical hinge for receiving one or more additional product packs.

Product packs such as cigarettes are normally sold as single units or by the carton. However, at times it is desirable for promotional purposes to market multiple product packs less then the number of packs included in a carton. For example, promotional activities may include a buy one get one free approach or buy two packs while receiving a third pack free. In order to properly implement a marketing approach of this type, desired packaging is necessary for holding two or three product packs in a single package.

SUMMARY OF THE INVENTION

Accordingly, one of the objects of the present invention is multi-pack packaging sleeve for holding and displaying multiple product packs in a desirable and appealing overall package.

Another object of the present invention is a multi-pack packaging sleeve which is easy to construct and convenient to use.

In accordance with the present invention a multi-pack packaging sleeve comprises first and second pack receiving pockets each having at least one open end for receiving product packs. A vertical hinge line extends between the pockets so that the pockets may be positioned back-to-back or in alignment with one another. A vertical slotted opening is positioned between the pack receiving pockets, and the opening extends from one end of the hinge line. The slotted opening is particularly beneficial in positioning the packaging sleeves in a display rack with front-to-back rails upon which the slotted openings are positioned.

The first pack receiving pocket is preferably constructed and arranged to receive a single product packet, and the second pocket is constructed and arranged to receive one or several product packs. When the second pack receiving pocket is dimensioned to receive two product packs the pocket includes side-by-side portions, each portion receiving a single product pack. With this configuration a second vertical slotted opening is provided between the side-by-side portions for positioning on the rails of the display rack.

Closure flaps may be connected to the first and second pack receiving pockets for closing one end of the pockets. The opposite ends remain open for insertion of the product packs.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Referring in more particularity to the drawings, FIGS. 1–4 illustrate a display rack 10 for holding multi-pack packaging sleeves 12 with product packs 14 positioned within the sleeves. Packaging sleeves 12 are particularly useful in packaging multiple cigarette packs, but the sleeve also has utility with respect to other types of product packs. Moreover, the packaging sleeves 12 are particularly useful for packaging two or three product packs sold in promotional activities such as buy one or two packs and get one pack free. As explained more fully below, the packing sleeves are normally used to pack two or three product packs.

Figure 2:
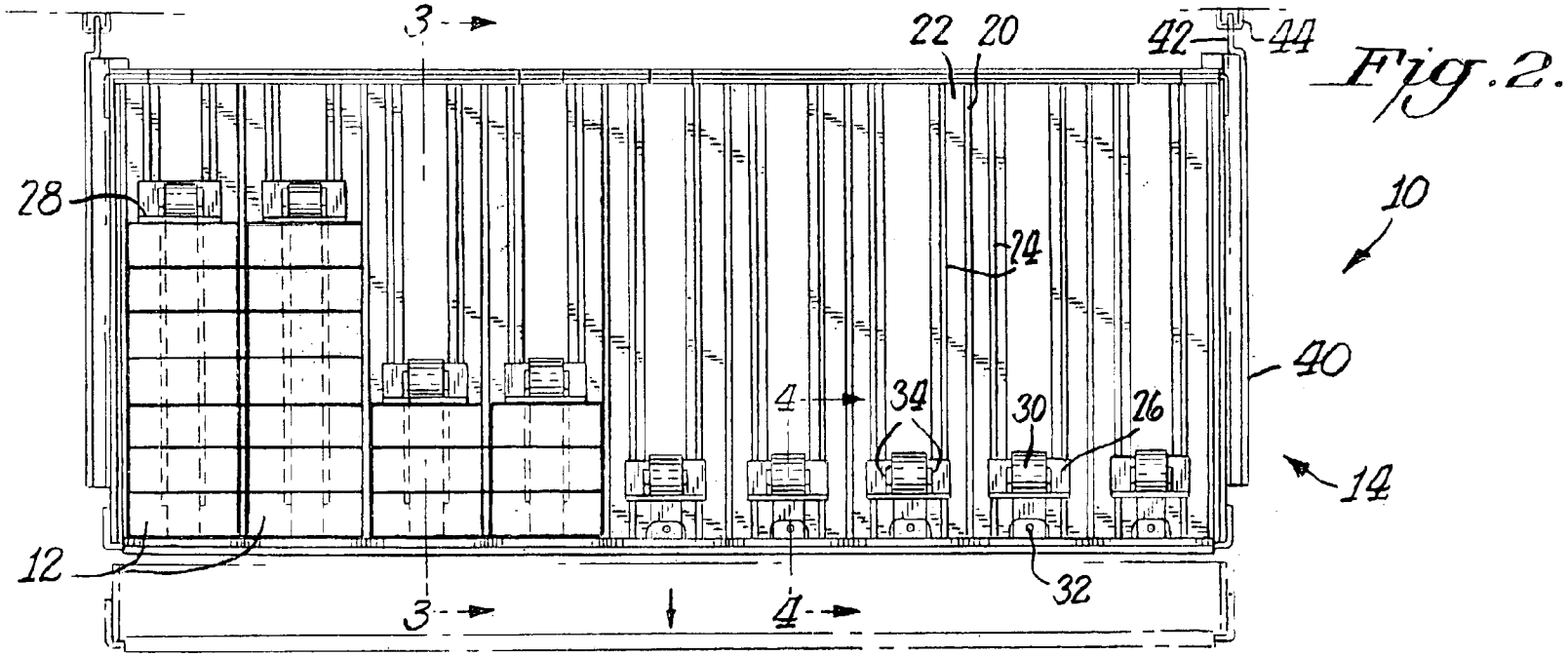
FIG. 2 is a top plan view of the display shelf assembly and multi-pack packaging sleeves filled with product packs as shown in FIG. 1, and also showing the shelf assembly in phantom outline in a pulled-out position.

As shown best in FIG. 2, the display rack 10 has a rectangular configuration and includes a plurality of spaced apart rails 20 extending from the front to the back of the rack. Each rail is connected to a bottom plate 22 having lower side portions 24 extending outwardly from the rail. Display rack 10 also includes a plurality of spring loaded dispenser arrangements 26, one positioned between each of the rails 20. Each dispenser unit 26 has an upright pusher plate 28 slidably connected to the side portions 24 of the bottom plate 22 of adjacent rails. Each pusher plate 28 is free to slide in a front-to-back direction, and is urged to the front by a tension coil spring 30. The front end of the spring is attached at the front of the display rack by a spring retainer pin 32 and the other end of the coil spring 30 simply rests against the back of the pusher plate 28, as shown best in FIG. 4. In this regard, the back of the pusher plate includes spaced apart angled ribs 34 between which the coil spring is located. With the spring loaded dispenser arrangement 26, each of pusher plates 28 is urged to the front of the display rack.

The display rack may be slidably connected to shelf arms 40 at opposite sides of the rack. The arms may include fastening structure 42 at the inner ends thereof for adjustable attachment to spaced apart vertical wall brackets 44. As shown best in FIG. 3, the fastening structure 42 may be in the form of hooks 46 that engage slotted opening 48 in the wall brackets. Also, each arm 40 may include a horizontal guide 50 for attachment to a U-shaped slide track 52 on the display rack. This arrangement allows the rack to slide outwardly away from the wall or other structure to which the shelf arms are connected. FIG. 2 illustrates the display rack in phantom outline in an outward position.

As explained more fully below, display rack 10 holds multi-pack packaging sleeves 12 and functions to urge the sleeves in the rack to forward positions near the front of the rack. The sleeves in the rack are positioned between the sliding pusher plate 28 of each spring loaded dispenser 26 and a stationary upright retainer plate 54 at the front of spring loaded dispenser.

Figure 5:
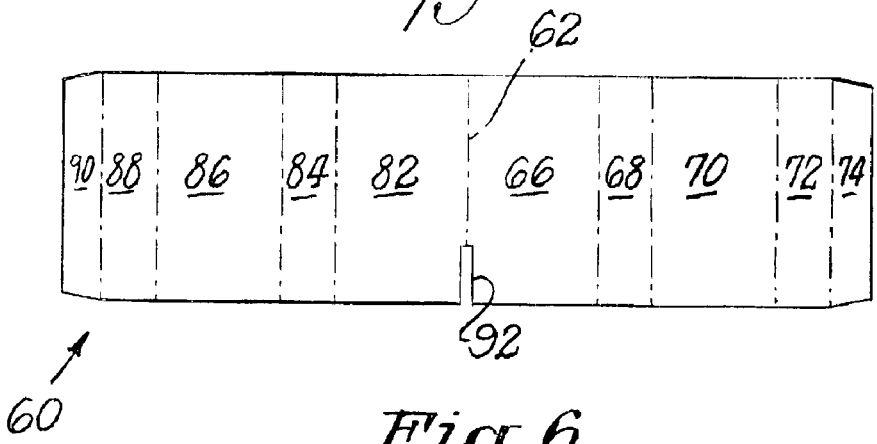
FIG. 5 is a top plan view of a blank with fold lines for a multi-pack packaging sleeve including a hinge line with a single pack receiving pocket on each side thereof, according to the present invention.

FIG. 5 is a plan view of a blank 60 with fold lines for a multi-pack packaging sleeve 12 that includes a hinge line with a single pack receiving pocket on each side thereof. The blank 60 of FIG. 5 is utilized to form the multi-pack packaging sleeve 12 of FIGS. 8 and 9. Fundamentally, the fold lines of FIG. 5 define various panels that collectively form the pack receiving pockets of the sleeve. In blank 60 a hinge line 62 is located at the center of the blank. A first pack receiving pocket 64 is formed from the panels to the right of the hinge line, and these panels include a front panel 66, an outer side panel 68, a back panel 70, an inner side panel 72 and a glue flap 74.

Blank 60 also forms a second pack receiving pocket 80 formed by the various panels to the left of the hinge line 62 in FIG. 5. These pocket forming panels include a front panel 82, an outside end panel 84, a back panel 86, an inside end panel 88 and a glue flap 90.

Blank 60 also includes a vertical slotted opening 92 between front panels 66, 82 and the slotted opening extends from the lower end of the hinge line 62. Blank 60 is formed into the multi-pack packaging sleeve 12 by folding the blank along the fold lines and subsequently securing glue flap 74 to the rear face of front panel 66 and by securing the glue flap 90 to the rear face of front panel 82.

Figure 6:
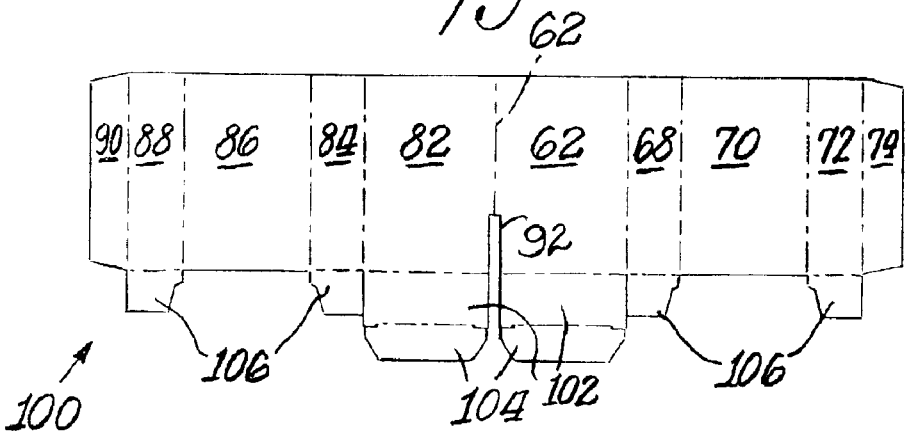
FIG. 6 is a top plan view of a blank with fold lines for a multi-pack packaging sleeve including a hinge line with a single pack receiving pocket having a closed bottom wall on each side thereof, according to the present invention.
Figure 10:
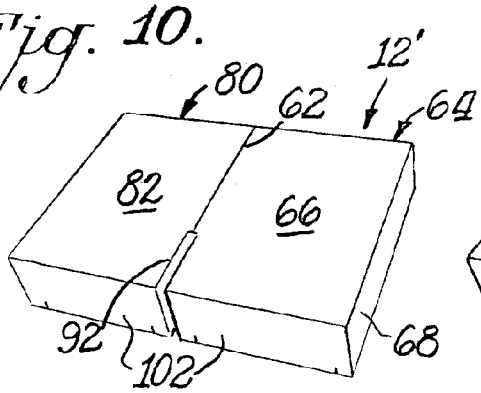
FIG. 10 is a front perspective view of a multi-pack packaging sleeve assembled from the blank of FIG. 6, according to the present invention.

FIG. 6 illustrates a blank 100 for producing the multi-pack packaging sleeve shown in FIG. 10. Blank 100 is similar in many respects to blank 60 and similar reference characters are used to identify similar parts. The major difference is that blank 100 is utilized to produce a sleeve 12' where the lower ends of the pockets 64, 80 are closed. In this regard front panel 66 has a bottom closure 102 at the lower end thereof and a retainer flap 104 extends from the bottom closure. The same bottom closure and retainer flap are associated with the front panel 82 of the second pack receiving pocket 80. Additionally, the outer side panels 68, 84 and the inner side panels 72, 88 each has a side tab 106 at the lower end thereof. After assembly as with the blank of FIG. 5, the side tabs 106 are folded inwardly and the bottom closures 102 and retainers 104 are folded into position to close the lower end of the first and second pack receiving pockets 64, 80.

Figure 7:
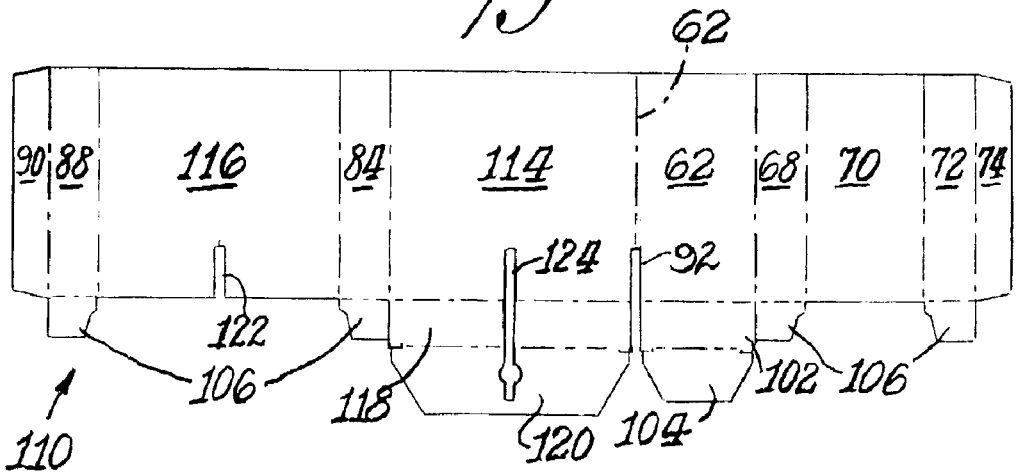
FIG. 7 is a top plan view of a blank with fold lines for a multi-pack packaging sleeve including a hinge line with a single pack receiving pocket on one side thereof and a double pack receiving pocket on the other side thereof, each pocket having a closed bottom wall, according to the present invention.
Figure 11:
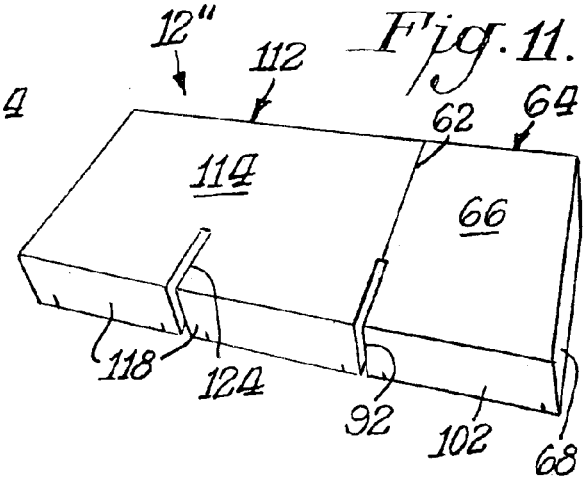
FIG. 11 is a front perspective view of a multi-pack packaging sleeve assembled from the blank of FIG. 7, according to the present invention.
Figure 12:
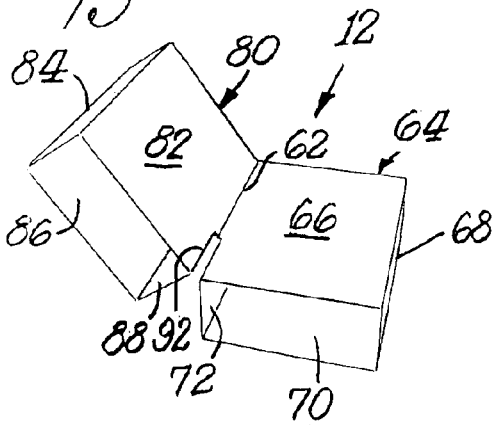
FIG. 12 is a front perspective view of the multi-pack packaging sleeve shown in FIG. 9 but with partial folding along the hinge line, according to the present invention.

FIG. 7 illustrates a blank 110 for producing a multi-pack packaging sleeve 12" as shown in FIG. 11. Blank 110 is similar in many respects to blank 100 and similar parts are identified by similar reference characters. Sleeve 12" assembled from blank 110 has a second pack receiving pocket 112 constructed and arranged to retain two product packs 14. Hence, a front panel 114 and back panel 116 are wider than corresponding panels 82 and 86 of blank 100. A wider bottom closure 118 extends from front panel 114, and a wider retainer flap 120 extends from closure 118. Assembly into the sleeve configuration of FIG. 11 is similar to that described above in connection with blanks 60 and 100 being formed into packaging sleeves 12' and 12", respectively.

The wider front panel 114 of blank 110 includes a slotted opening 124 that extends across the bottom closure 118 and into retainer flap 120. Also, the wider back panel 116 includes a slotted opening 122. When blank 110 is assembled into sleeve 12", the openings 122 and 124 are in alignment with one another and these openings straddle one of the rails 20 of display rack 10 adjacent to the rail on which opening 92 is positioned.

Figure 8:
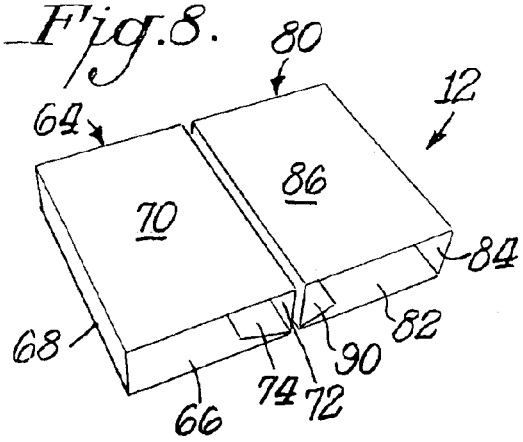
FIG. 8 is a rear perspective view of a multi-pack packaging sleeve assembled from the blank of FIG. 5, according to the present invention.
Figure 9:
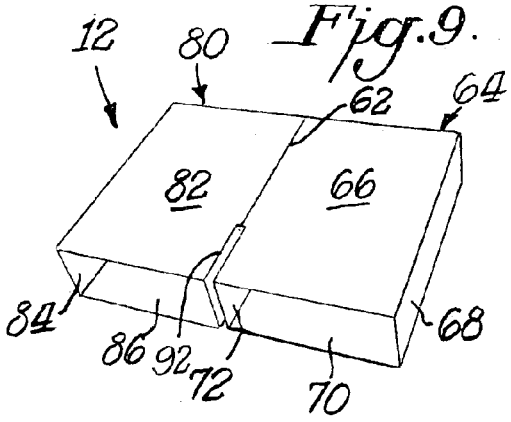
FIG. 9 is a front perspective view of the multi-pack packaging sleeve shown in FIG. 8, according to the present invention.
Figure 14:
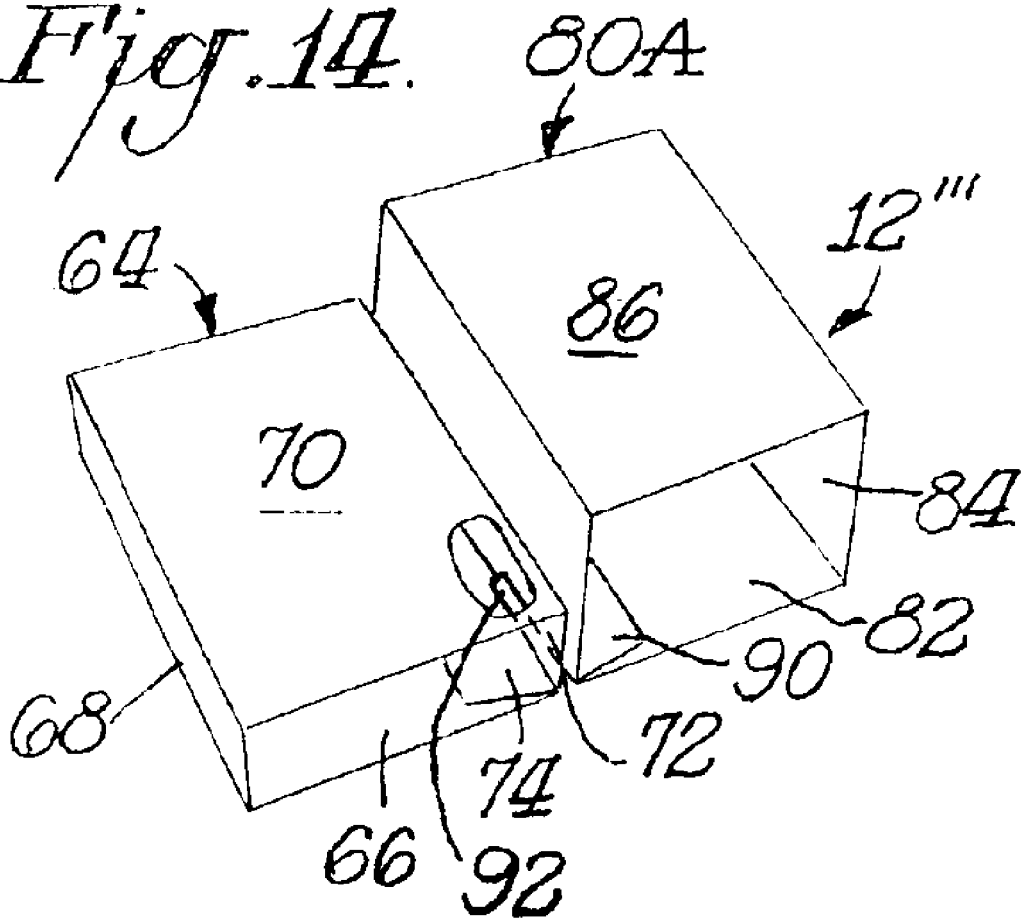
FIG. 14 is a rear perspective view of another multi-pack packaging sleeve, according to the present invention.

FIG. 14 shows another multi-pack packaging sleeve 12''' similar in many respects to sleeve 12 shown in FIGS. 8 and 9, and similar reference characters are used to identify similar parts. The major difference is that sleeve 12''' has a pocket 80A dimensioned to receive two packs in back-to-back relationship to one another. The other pocket 64 is the same as in sleeve 12. Hence, sleeve 12''' holds three product packs with one pack in pocket 64 and two packs in pocket 80A.

Figure 13:
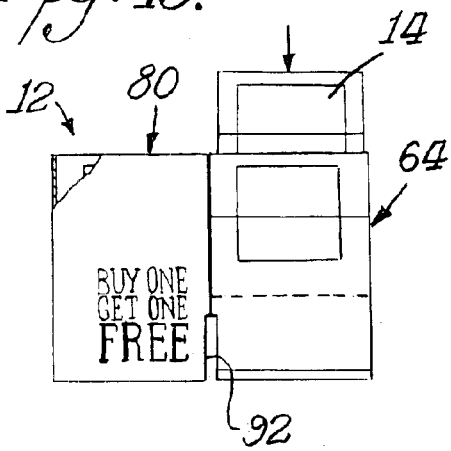
FIG. 13 is a front elevational view of the multi-pack packaging sleeve shown in FIGS. 9 and 12 with product packs inserted into the pack receiving pockets, according to the present invention.

The multi-pack packaging sleeves 12, 12', 12", 12''' of the present invention may be fabricated from cardboard or any other suitable material. The blanks 60, 100, 110 as well as a blank (not shown) for sleeve 12''' are cut to size and assembled by folding along the fold lines between adjacent panels. The flaps 74, 90 are glued or otherwise secured in place, and where appropriate, the closure flaps are folded into place to complete the assembly. Product packs 14 such as shown in FIG. 13 are inserted into the pack receiving pockets 64, 80, 80A of the sleeves.

Figure 1:
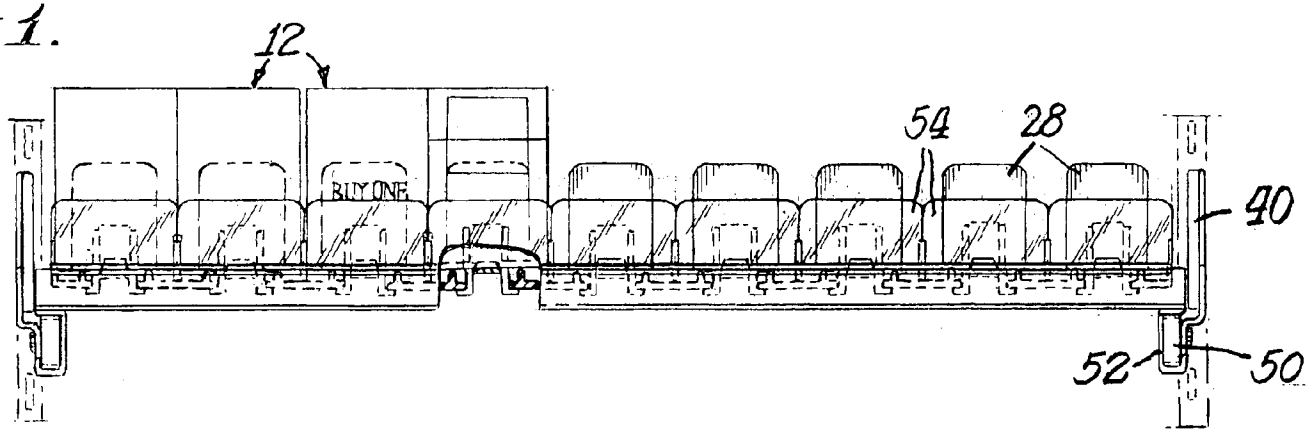
FIG. 1 is a front elevational view of a display shelf assembly in combination with multi-pack packaging sleeves filled with product packs, according to the present invention.
Figure 3:
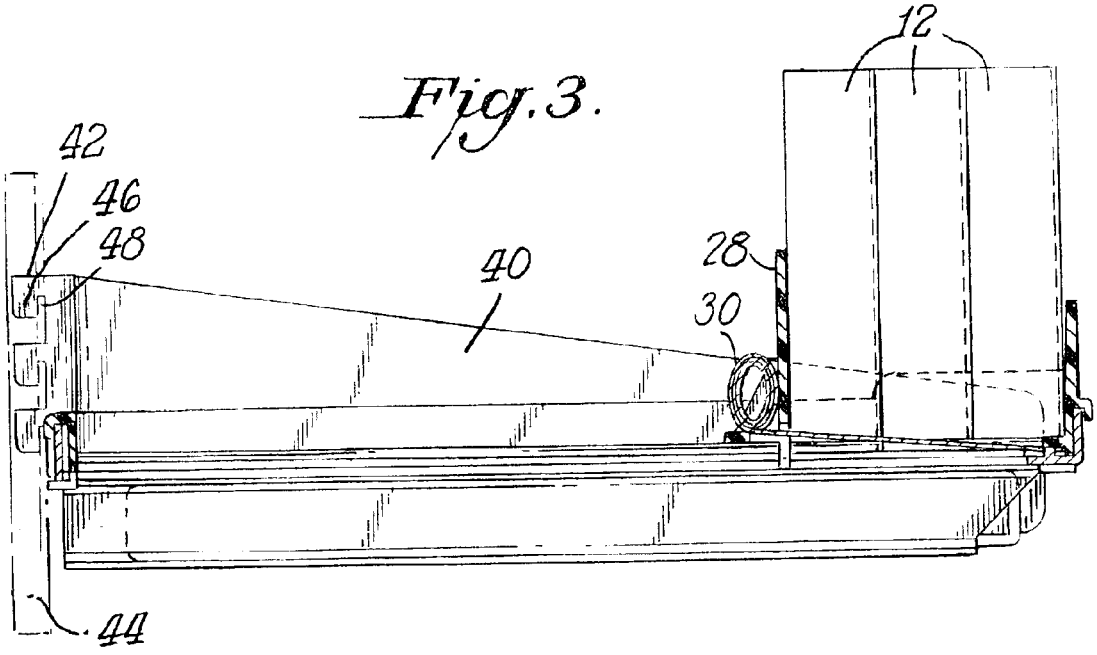
FIG. 3 is a side elevational view in cross-section taken along line 3—3 of FIG. 2 with three individual sleeves, according to the present invention.
Figure 4:
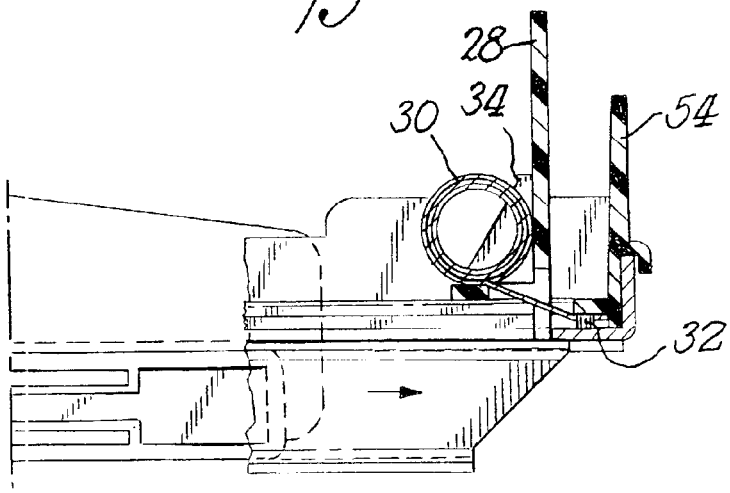
FIG. 4 is a side elevational view in cross-section taken along line 4—4 of FIG. 2 showing an empty display shelf portion.

The sleeves with product packs therein may be distributed in cartons with 10 packs per carton, and ultimately displayed and dispensed from the display rack 10. As shown in FIGS. 1 and 2, sleeves 12 are positioned in the display rack between movable pusher plates 28 and stationary retainer plates 54. When sleeve 12" is positioned on the display rack, the slotted openings 92, 122 and 124 straddle adjacent rails 20. As the packaging sleeves are removed from the display rack, the remaining sleeves in alignment therewith are urged in a forward direction by the coil springs 30.

We claim:

1. A multi-pack packaging sleeve comprising front, back and side wall panels forming first and second pack receiving pockets each having at least one open end, a vertical hinge line between the pockets in the front wall panels, and a vertical slotted opening in the front wall panels defining a gap of given width between the pack receiving pockets wider than the hinge line and extending from one end of the hinge line whereby the gap is constructed and arranged to fit over a rail of a display rack.

2. A multi-pack packaging sleeve as in claim 1 wherein the first pocket is constructed and arranged to receive a single product pack and the second pocket is constructed and arranged to receive multiple product packs.

3. A multi-pack packaging sleeve as in claim 2 wherein the second pack receiving pocket is constructed and arranged to receive two product packs in back-to-back relationship.

4. A multi-pack packaging sleeve as in claim 2 wherein the second pack receiving pocket is constructed and arranged to receive two product packs in side-to-side relationship.

5. A multi-pack packaging sleeve as in claim 1 wherein each pocket has one open end, and first and second closure flaps connected to the first and second pack receiving pockets closing the other end of the first and second pockets.

6. A multi-pack packaging sleeve as in claim 5 wherein the first pocket is constructed and arranged to receive a single product pack and the second pocket is constructed and arranged to receive multiple product packs.

7. A multi-pack packaging sleeve as in claim 1 in combination with at least one product pack in each of the pack receiving pockets.

8. A multi-pack packaging sleeve as in claim 2 in combination with product pack in the first pocket and multiple product packs in the second pocket.

9. A multi-pack packaging sleeve as in claim 3 in combination with product pack in the first pocket and two product packs in the second pocket.

10. A multi-pack packaging sleeve as in claim 4 in combination with product pack in the first pocket and two product packs in the second pocket.

11. A multi-pack packaging sleeve as in claim 5 in combination with at least one product pack in each of the pack receiving pockets.

12. A multi-pack packaging sleeve as in claim 6 in combination with one product pack in the first pocket and multiple product packs in the second pocket.

13. A multi-pack packaging sleeve comprising front, back and side wall panels forming first and second pack receiving pockets each having at least one open end, a vertical hinge line between the pockets in the front wall panels, and a vertical slotted opening in the front wall panels defining a gap of given width wider than the hinge line and between the pack receiving pockets extending from one end of the hinge line, and wherein the first pocket is constructed and arranged to receive a single product pack and the second pocket is constructed and arranged to receive multiple product packs and the second pack receiving pocket includes side-by-side portions, each portion for receiving a product pack, and a second vertical slotted opening defining a second gap of given width between the side-by-side portions whereby the gaps are constructed and arranged to fit over spaced apart rails of a display rack.

14. A multi-pack packaging sleeve as in claim 13 wherein each pocket has one open end, and first and second closure flaps connected to the first and second pack receiving pockets closing the other end of the first and second pockets.

* * * * *